US008490217B2

(12) United States Patent
Safford

(10) Patent No.: US 8,490,217 B2
(45) Date of Patent: Jul. 23, 2013

(54) GLOVE WITH INDEX FINGER GRIP AND IMPACT GUARD

(75) Inventor: Kenny Safford, Simi Valley, CA (US)

(73) Assignee: Mechanix Wear, Incorporated, Valencia, CA (US)

( * ) Notice: Subject to any disclaimer, the term of this patent is extended or adjusted under 35 U.S.C. 154(b) by 0 days.

(21) Appl. No.: 13/156,175

(22) Filed: Jun. 8, 2011

(65) Prior Publication Data

US 2012/0311754 A1 Dec. 13, 2012

(51) Int. Cl.
*A41D 19/015* (2006.01)

(52) U.S. Cl.
USPC ..... 2/161.6; 2/161.8; 2/163

(58) Field of Classification Search
USPC ..... 2/161.6, 161.1, 161.2, 161.3, 161.8, 2/163, 159, 16, 20, 21, 160, 161.5
See application file for complete search history.

(56) References Cited

U.S. PATENT DOCUMENTS

| | | | | | |
|---|---|---|---|---|---|
| 3,348,238 | A | * | 10/1967 | Hydock | 2/161.2 |
| 3,882,548 | A | | 5/1975 | Shinagawa | |
| 3,918,096 | A | * | 11/1975 | Lim | 2/161.1 |
| 4,094,014 | A | * | 6/1978 | Schroeder | 2/161.8 |
| D248,898 | S | * | 8/1978 | DeLeone et al. | D29/117.1 |
| 4,590,625 | A | * | 5/1986 | Keim | 2/161.3 |
| D288,981 | S | * | 3/1987 | Hale | D29/123 |
| 4,768,234 | A | * | 9/1988 | Yamamoto | 2/16 |
| 4,911,433 | A | * | 3/1990 | Walker et al. | 482/105 |
| 5,067,175 | A | * | 11/1991 | Gold | 2/16 |
| 5,423,089 | A | * | 6/1995 | Chun et al. | 2/161.2 |
| 5,604,934 | A | * | 2/1997 | Willett | 2/161.1 |
| 6,405,380 | B1 | * | 6/2002 | Kuroda et al. | 2/161.1 |
| 6,415,445 | B1 | * | 7/2002 | Nishijima et al. | 2/161.4 |
| D461,620 | S | * | 8/2002 | Bevier | D2/623 |
| D490,966 | S | * | 6/2004 | Sasaki | D2/623 |
| 7,337,474 | B1 | * | 3/2008 | Godson | 2/161.2 |
| D608,978 | S | * | 2/2010 | Votel | D2/617 |
| D653,427 | S | * | 2/2012 | Wong | D2/619 |
| 2007/0245453 | A1 | * | 10/2007 | Dolenak | 2/161.6 |
| 2008/0263747 | A1 | * | 10/2008 | DeBlasis et al. | 2/161.1 |
| 2009/0229035 | A1 | * | 9/2009 | Van Hale | 2/161.6 |
| 2011/0088139 | A1 | * | 4/2011 | Travell | 2/161.1 |
| 2011/0107498 | A1 | * | 5/2011 | Chang | 2/163 |

FOREIGN PATENT DOCUMENTS

KR 300416270.0000 * 6/2006

* cited by examiner

*Primary Examiner* — Amy Vanatta
(74) *Attorney, Agent, or Firm* — Law Offices of Eric Karich

(57) ABSTRACT

A glove has a top panel and a bottom panel that together form a main glove body. Fingers, including an index finger and other fingers, extend from the main glove body, each of the fingers having a top side and a bottom side corresponding with the top panel and bottom panels of the main glove body. A thumb extends from the main glove body. A region, at a juncture of the index finger and the main glove body on or adjacent the top panel and/or the thumb, has an insulating pad covering a portion of the region.

7 Claims, 2 Drawing Sheets

GLOVE WITH INDEX FINGER GRIP AND IMPACT GUARD

BACKGROUND OF THE INVENTION

1. Field of the Invention

This invention relates generally to gloves, and more particularly to a protective glove that is particularly adapted for use in tight spaces.

2. Description of Related Art

Protective gloves are known in the art, including gloves that include various forms of protective panels and ridges for protecting the back of the user's hand. For example, Shinagawa, U.S. Pat. No. 3,882,548, teaches a glove with protective ridges that extend down the backs of all of the fingers to a traverse region that protects the knuckles of the user. Importantly, when a glove includes such protective ridges, the extend down all of the fingers, including the index finger, and the knuckle protecting traverse region extends all the way across the back of the glove to the index finger.

The disadvantage of such a glove construction is that the protective ridges are thick enough to impede work in confined spaces. The protective ridge on the index finger, and in a region around the index finger and the thumb, especially impedes work in a confined space. The above-described reference is hereby incorporated by reference in full.

The prior art teaches protective gloves that include protective ridges on all fingers, or on none. However, the prior art does not teach a glove that includes protective ridges on fingers excluding the index finger, but leave the index finger unencumbered. The prior art also does not teach the inclusion of an insulating pad in the region, to protect the user from burns in the critical region. The present invention fulfills these needs and provides further related advantages as described in the following summary.

SUMMARY OF THE INVENTION

The present invention teaches certain benefits in construction and use which give rise to the objectives described below.

The present invention provides a glove for protecting a hand. The glove comprises a top panel for covering a back of the hand; a bottom panel for covering a palm of the hand, the top and bottom panels being connected to form a main glove body; fingers, including an index finger and other fingers, extending from the main glove body, each of the fingers having a top side and a bottom side corresponding with the top panel and bottom panels of the main glove body; and a thumb extending from the main glove body. A region, at a juncture of the index finger and the main glove body on or adjacent the top panel and/or the thumb, has an insulating pad covering a portion of the region.

A primary objective of the present invention is to provide a glove having advantages not taught by the prior art.

Another objective is to provide a glove that includes an insulating pad over a region of the glove that is particularly susceptible to injury.

A further objective is to provide a glove that includes an index finger that does not include protrusions, so that the index finger may be inserted into tight places without hindrance from the glove.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a glove for protecting a hand of a user. The glove particularly well adapted for working in tight places, and includes a specially configured index finger having an insulating pad operatively positioned to protect the user's hand without interfering with the use of the index finger within the tight place.

Figure 1:
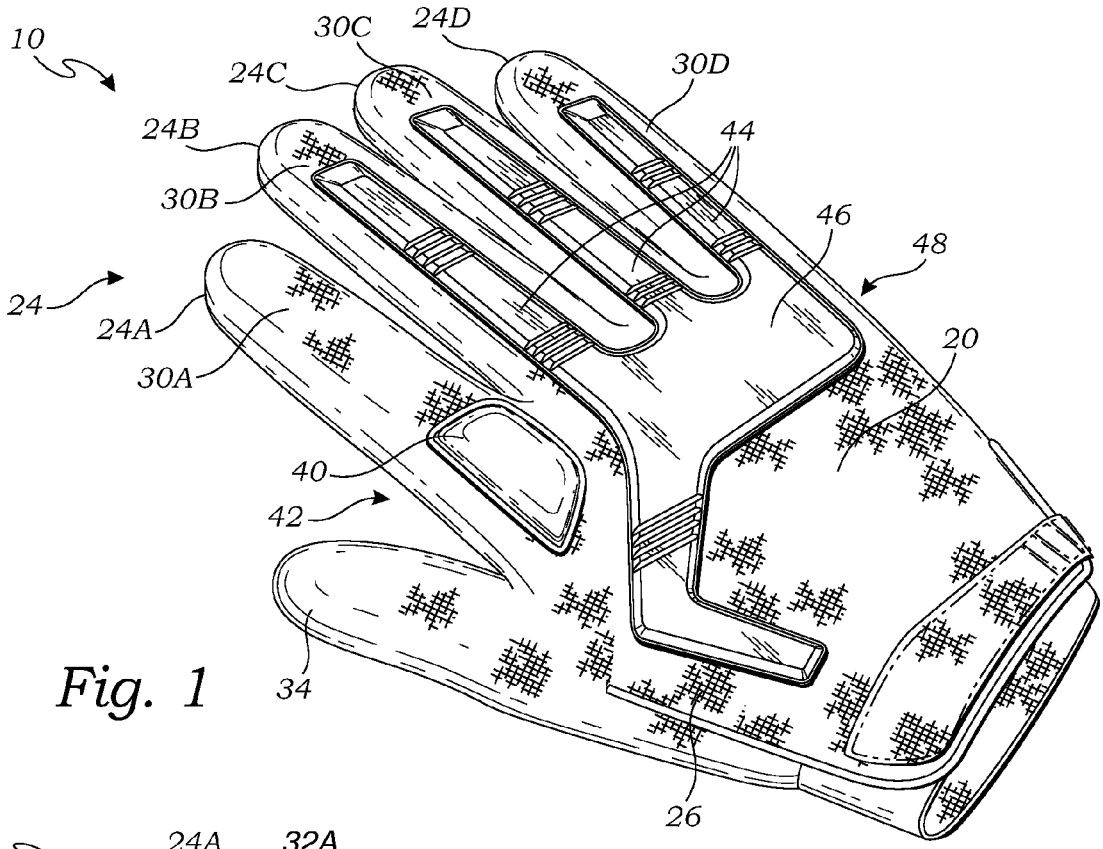
FIG. 1 is a top perspective view of a glove according to one embodiment of the present invention.
Figure 2:
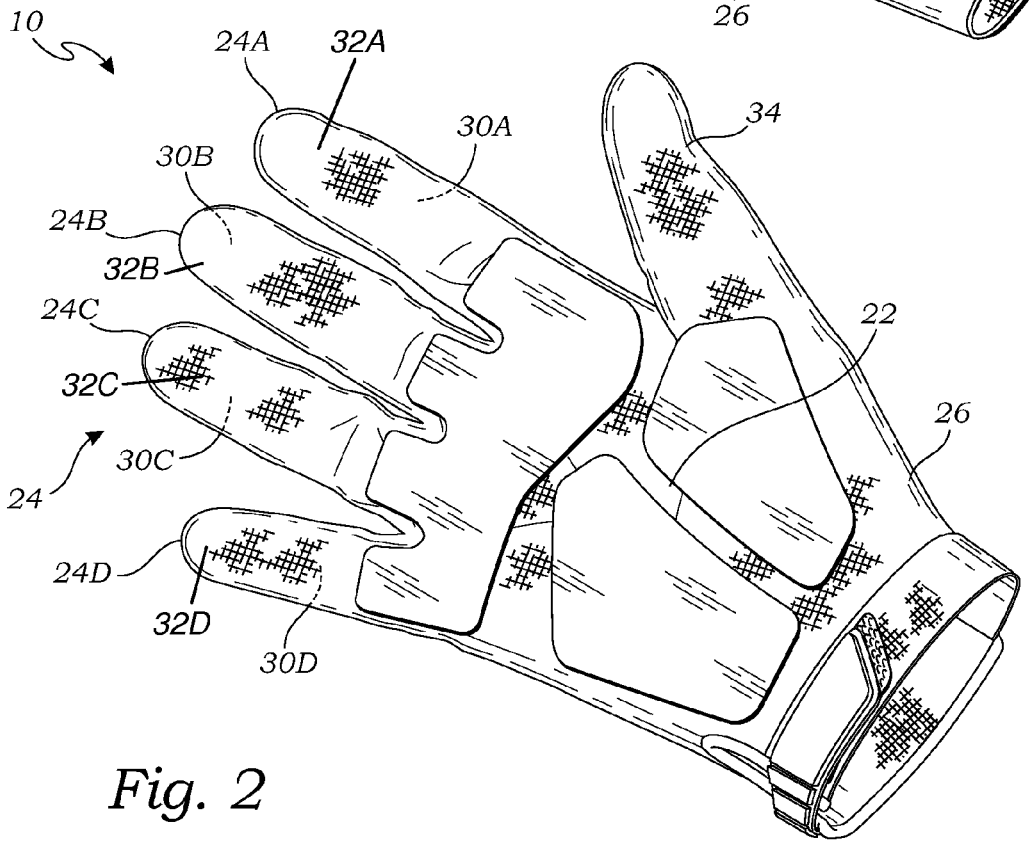
FIG. 2 is a bottom perspective view thereof.
Figure 3:
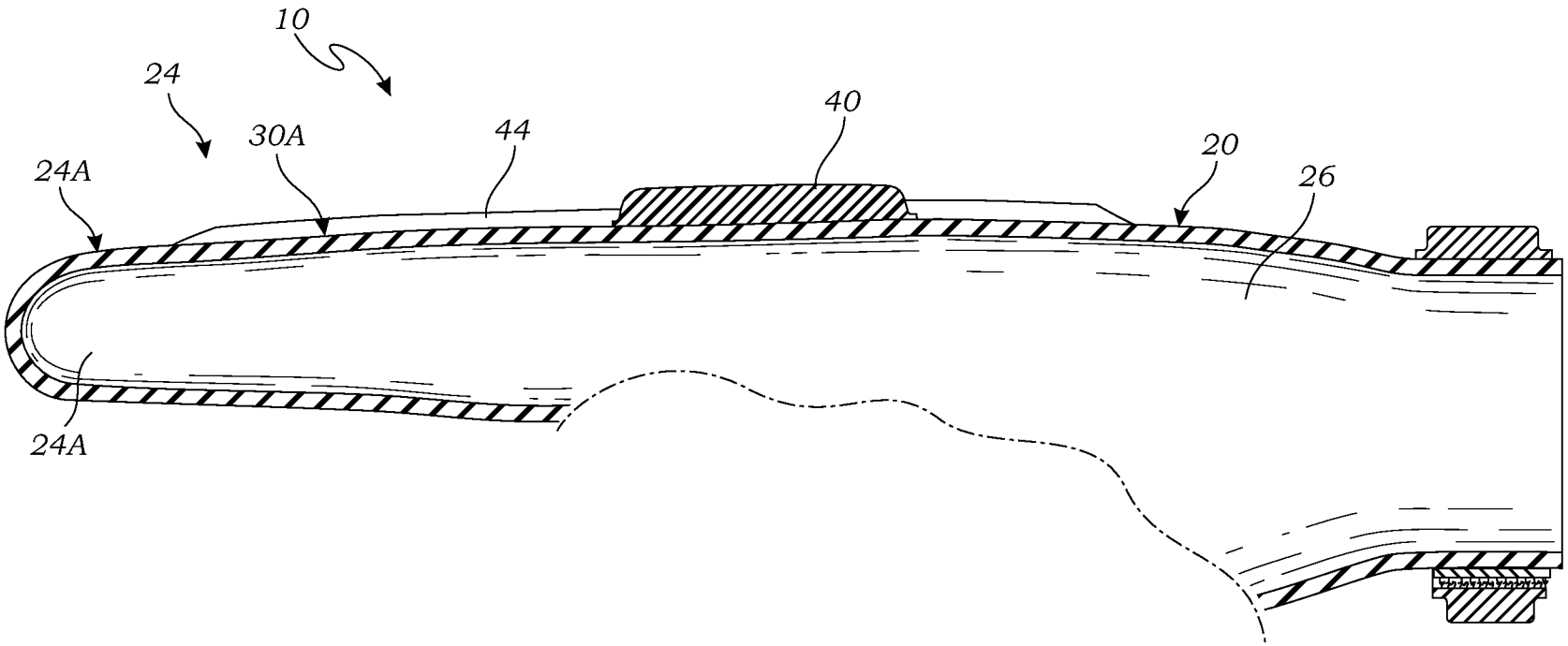
FIG. 3 is a side sectional view of an index finger of the glove, illustrating an insulating pad of the glove.

FIG. 1 is a top perspective view of the glove 10 according to one embodiment of the present invention. FIG. 2 is a bottom perspective view thereof. As shown in FIGS. 1-2, the glove 10 includes a top panel 20 for covering a back of the hand, an opposed bottom panel 22, and fingers 24. FIG. 3 is a side sectional view of an index finger 24A of the glove 10, illustrating an insulating pad 40 of the glove 10.

As illustrated in FIGS. 1-4, the top panel 20 is shaped and constructed for covering a back of the hand. The bottom panel 22 is shaped and constructed for covering a palm of the hand. The top and bottom panels 22 are connected (e.g., sewn) to form a main glove body 26. The fingers 24, including an index finger 24A and other fingers 24B, 24C, and 24D, extend from the main glove body 26 and are shaped to each receive a finger of the hand. Each of the fingers 24 includes a top side 30A, 30B, 30C, and 30D and a bottom side 32A, 32B, 32C, and 32D corresponding with the top panel 20 and bottom panels 22 of the main glove body 26. A thumb 34 extends from the main glove body 26 shaped to accommodate the user's thumb 34.

The general construction of the glove 10 is similar to prior art gloves 10, and is therefore not discussed in greater detail.

Critical to the invention is the insulating pad 40 positioned within a region 42 at a juncture of the index finger 24A and the main glove body 26 on or adjacent the top panel 20 and/or the thumb 34. In one embodiment, the insulating pad 40 is a rubberized grip insert that is sewn, bonded, or otherwise attached to the region 42 of the glove 10. The insulating pad 40 is positioned to protect the user's hand from damage, and in particular from burns, when the user is inserting his or her hand into a tight location that might have elements that are hot (e.g., inside an engine, etc.). In one embodiment, the insulating pad 40 does not extend beyond the region 42, but is only positioned within the region 42 for protecting the user from injuries particular to this region 42. In the preferred embodiment, the insulating pad 40 is positioned over the proximal phalange of the user's index finger, and does not extend to the medial phalange or the metacarpal of the user's hand.

To further protect the user's hand, the glove 10 may further include thermoplastic or molded rubber protective ridges 44 extending upwardly from the top panel 20 of each of the other fingers 24B, 24C, and 24D. However, it is preferred that the index finger 24A not include such a protective ridge 44.

In the embodiment of FIG. 1, the glove 10 further includes a knuckle protector 46 extending across a knuckle region 48 of the top panel 20. The knuckle panel may be integrally formed with the protective ridges 44 of the other fingers 24B, 24C, and 24D, but preferably does not extend into the region 42 of the insulating pad 40.

In this manner, the index finger 24A of the glove 10 does not include protrusions that extend outwardly from the glove 10 in a manner that might restrict use of the glove 10 in tight spaces; and yet the insulating pad 40, carefully positioned in the region 42 specified, operates to protect the user from injury and burns in this region 42 that is particularly susceptible to injury when being used in this manner.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A glove for protecting a hand, the glove comprising:

a top panel for covering a back of the hand;

a bottom panel for covering a palm of the hand, the top and bottom panels being connected to form a main glove body;

fingers, including an index finger and other fingers, extending from the main glove body, each of the fingers having a top side and a bottom side corresponding with the top panel and bottom panels of the main glove body;

a thumb extending from the main glove body;

a region at a juncture of the index finger and the main glove body on or adjacent the top panel; and an insulating pad covering a portion of the region and partially positioned on the index finger, partially positioned on the main glove body, and not extending over a medial phalange of a user's hand when the glove is worn; and thermoplastic or molded rubber protective ridges extending upwardly from the top panel of each of the other fingers, but excluding the index finger which does not include such a protective ridge.

2. The glove of claim 1, wherein the insulating pad is a rubberized grip insert that is sewn into the region of the glove.

3. The glove of claim 1, wherein the insulating pad does not extend beyond the region.

4. The glove of claim 1, further comprising a knuckle protector extending across a knuckle region of the top panel, the knuckle protector being integrally formed with the protective ridges of the other fingers, but not extending into the region of the insulating pad.

5. The glove of claim 1, wherein the insulating pad is positioned over a proximal phalange of the user's hand when the glove is worn.

6. The glove of claim 5, wherein the insulating pad does not extend over a medial phalange or a metacarpal of the user's hand when the glove is worn.

7. A glove for protecting a hand, the glove comprising:

a top panel for covering a back of the hand;

a bottom panel for covering a palm of the hand, the top and bottom panels being connected to form a main glove body;

fingers, including an index finger and other fingers, extending from the main glove body, each of the fingers having a top side and a bottom side corresponding with the top panel and bottom panels of the main glove body;

a thumb extending from the main glove body;

a region at a juncture of the index finger and the main glove body on or adjacent the top panel;

a rubberized grip insert that is attached to the region of the glove;

thermoplastic or molded rubber protective ridges extending upwardly from the top panel of each of the other fingers, but excluding the index finger which does not include such a protective ridge; and a knuckle protector extending across a knuckle region of the top panel, the knuckle protector being integrally formed with the protective ridges of the other fingers, but not extending into the region of the rubberized grip insert;

wherein the rubberized grip insert is positioned over a proximal phalange of the user's hand and does not extend over a medial phalange or a metacarpal of the user's hand when the glove is worn.

* * * * *